US006434890B1

(12) United States Patent
Konnerth

(10) Patent No.: US 6,434,890 B1
(45) Date of Patent: Aug. 20, 2002

(54) ROOM ENCLOSURE COMPRISED OR PREFABRICATED ELEMENTS SUCH AS OUTER WALLS, PARTITIONS AND INTERMEDIATE FLOORS OR THE LIKE AND A METHOD FOR THE ASSEMBLY THEREOF

(76) Inventor: Alfred Konnerth, Iphöfer Weg 5, D-97350 Mainbernheim (DE)

( * ) Notice: Subject to any disclaimer, the term of this patent is extended or adjusted under 35 U.S.C. 154(b) by 0 days.

(21) Appl. No.: 09/581,124

(22) PCT Filed: Oct. 11, 1999

(86) PCT No.: PCT/EP99/07619

§ 371 (c)(1),
(2), (4) Date: Jun. 8, 2000

(87) PCT Pub. No.: WO00/22254

PCT Pub. Date: Apr. 20, 2000

(30) Foreign Application Priority Data

Oct. 9, 1998 (DE) ..... 198 46 599

(51) Int. Cl.[7] ..... E04H 1/00

(52) U.S. Cl. ..... 52/79.1; 52/220.1; 52/220.7; 52/169.5

(58) Field of Search ..... 52/79.1, 169.5, 52/220.1, 220.7

(56) References Cited

U.S. PATENT DOCUMENTS 5,327,699 A 7/1994 Khan et al.
5,930,960 A * 8/1999 Konnerth ..... 52/169.5

* cited by examiner

*Primary Examiner*—Lanna Mai
*Assistant Examiner*—Dennis L. Dorsey
(74) *Attorney, Agent, or Firm*—Van Dyke, Gardner, Linn & Burkhart, LLP

(57) ABSTRACT

A simple, economic and rapid method for the reliable and precise erection of sturdy room delimiting means in new and semi-finished building and, respectively, for incorporation in pre-existing room and the room delimiting means includes modular prefabricated elements, stiffening and connecting elements and fastening elements. The prefabricated elements include groove and tongue like recesses and projections at their ends for connecting to other prefabricated elements. The stiffening and connecting elements stiffen, fasten and/or connect the prefabricated elements and are arrangable at a recess and/or space to connect the prefabricated elements. The stiffening and connecting elements may be adapted in an extremely simple fashion for different stiffening and connecting purposes so that erection of the room delimiting means requires only a few different parts.

20 Claims, 16 Drawing Sheets

Fig. 4
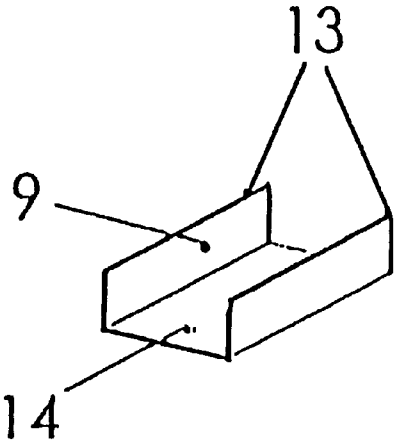
Fig. 4a
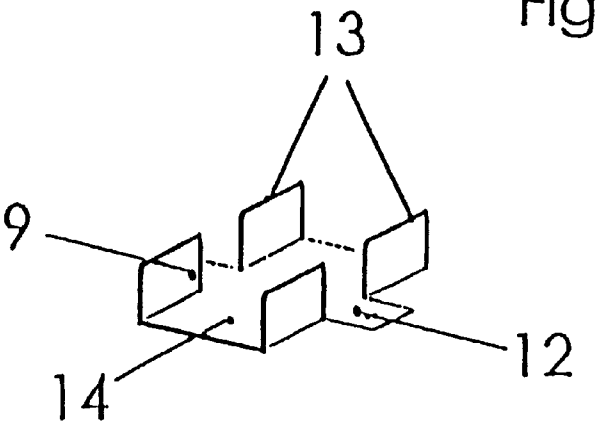
Fig. 4b
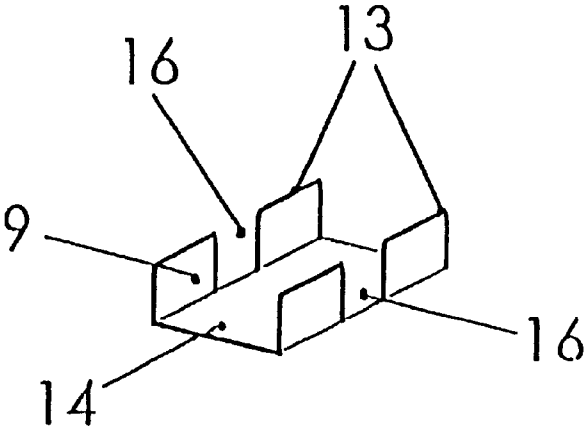
Fig. 4c

Fig. 5
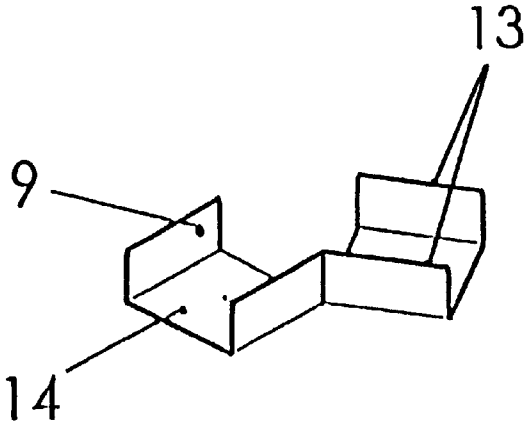
Fig. 5a
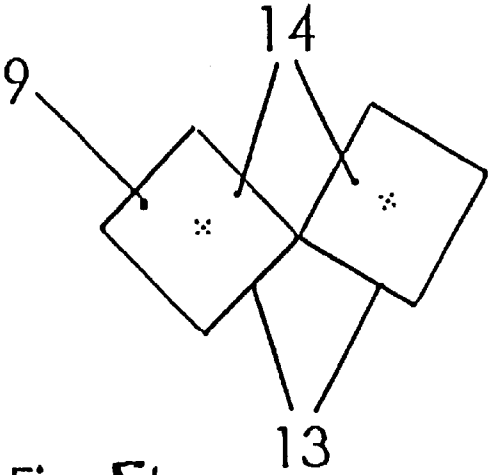
Fig. 5b
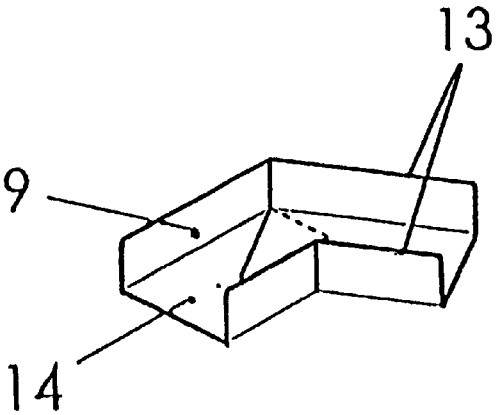
Fig. 5c
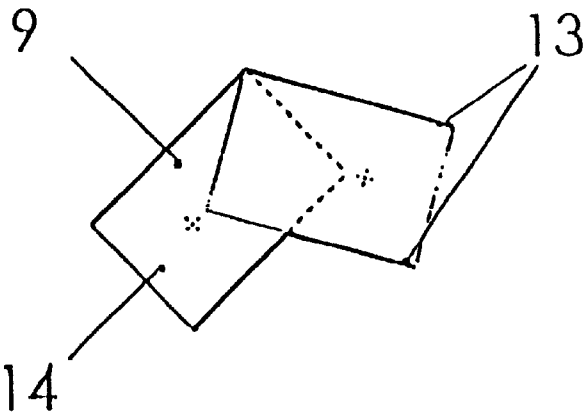
Fig. 5d

ROOM ENCLOSURE COMPRISED OR PREFABRICATED ELEMENTS SUCH AS OUTER WALLS, PARTITIONS AND INTERMEDIATE FLOORS OR THE LIKE AND A METHOD FOR THE ASSEMBLY THEREOF

CROSS REFERENCE TO RELATED APPLICATIONS

The present application is a 371 application of PCT application, Application No. PCT/EP99/07619, filed Oct. 11, 1999, which claims priority on German Application No. 19846599.8, filed Oct. 9, 1998.

FIELD OF THE INVENTION

The present invention relates to a room delimiting means composed of prefabricated elements, such as outer walls, partitions and story terminating means or the like and to a method for erecting same.

BACKGROUND OF THE INVENTION

In the last few years construction and building technology has seen a development, in which by making erection as rational and rapid as possible the time needed, and the costs involved, for the completion of buildings may be reduced as much as possible. In order to achieve this aim reliance is being placed to an increasing extent on prefabricated components, that is to say parts of buildings are being produced off site and then fitted together and installed later. One example for such prefabricated parts is prefabricated wall elements, which are employed more particularly for the erection of load-free partitions in semi-finished buildings or for later installation in rooms which have already been produced, as for example in open-plan offices, apartments to be modernized and the like. One example for this is to be found in the German patent publication 19,611,388 A1, which describes a prefabricated wall element with integrated conduit passages.

SUMMARY OF THE INVENTION

In order to attain an advantage as regards time and costs when building using prefabricated parts it is on the one hand possible to improve the manufacture and design of the prefabricated element themselves. On the other hand a decisive point as regards assembly on the building site is that the prefabricated elements are able to be simply, reliably and rapidly mounted.

One object of the present invention is the production of room delimiting means such as outer walls, partitions, story delimit means, roof elements and the like, which render possible rapid, precise and economic assembly in position, with, more particularly, the advantages of prefabricated wall systems, for the production of outer walls and, respectively, story delimiting means. More especially it is intended to make available a multiplicity of different variations in outer walls, partitions, story delimiting means with more particularly pre-installed installation and/or heating and services and supply conduits in the simple manner, which has been noted.

This aim is to be achieved by the characterizing features of the independent claims. Preferred embodiments of the invention are described in the dependent claims.

In the case of the method of the invention for the erection of outer walls, partitions, roof elements or delimiting means for stories or, respectively, of the room delimiting means produced therewith modular prefabricated elements are employed, which comprise a monolithic core element or a core element in the form of a composite element and at least one surface element. Preferably transversely and longitudinally extending or horizontally and vertically extending means are provided in the conduit means in the form of channels. More especially prefabricated elements are employed in the case of which the conduit means are present in the form of outwardly open channels on both terminal sides constituting the principal faces. Such a modular prefabricated element is described in the said German patent publication 19,611,388 A1.

For connection of the prefabricated elements together and with the wall, ceiling or floor of a room or, respectively, for stiffening the modular prefabricated elements and connecting stiffening elements are provided, which are fitted in recesses or intermediate spaces in the prefabricated elements. In the case of the recesses it is preferably a question of grooves or groove and tongue joints between the prefabricated elements. As an alternative or in a complementary manner it is possible for the stiffening and connecting elements also to be fitted in intermediate spaces in the prefabricated elements, which are either already provided for them in the prefabricated elements or are fitted in the prefabricated elements when the connection is produced. The important point is that the stiffening and connecting elements on the one hand jointly act to provide for stiffening of the prefabricated elements and on the other hand to ensure a connection of the prefabricated elements with one another or with the walls or floor/ceiling of the room so that it is possible to dispense with additional components, something which leads to savings in time and money. It is more especially an advantage with the present invention that as far as possible only one or at the most merely a few stiffening and connecting elements are provided for different stiffening and connecting purposes univesally. This leads to the advantage that on the building site only a few different components must be stocked and accordingly stockholding costs are reduced and furthermore the expense of stocking and ordering different parts may be cut down.

The stiffening and connecting elements are, in the present invention, at least partly attached by fastening elements to the prefabricated elements or to the wall, ceiling or, respectively, floor of the room or, respectively, both to the prefabricated elements and also the wall, ceiling or, respectively, floor in order to so to ensure reliable fastening of the room delimiting means to ther wall, ceiling or, respectively, floor or to ensure the connection of the prefabricated elements. This ensures a safe and strong design of the room dividing means composed of the prefabricated elements.

For the room delimiting means in accordance with the invention or, respectively, the method for the erection thereof it is particularly preferred to employ prefabricated elements, which on the one hand at the principal faces possess horizontal and/or vertical or, respectively, transverse and longitudinally extending channels and on the other hand possess groove- and tongue-like recesses and projections on two opposite narrow sides, by means of which the connection of the prefabricated elements is facilitated. For such prefabricated elements the present invention is more particularly suitable, since the structure in accordance with the invention renders it possible to simply meet special joining requirements as regards providing the prefabricated elements with horizontal and/or vertical or, respectively, transversely and/or longitudinally extending channels. Furthermore, prefabricated elements with groove and tongue joints offer suitable space for the application of the stiffening and connecting elements. It is more especially advantageous to use prefabricated elements, in the case of which the groove and tongue-like projections and recesses on the narrow sides to be connected are already preformed by the channels on the core element or are preformed by the arrangement of the surface elements on the core element. This is something also offering advantages in connection with the manufacture of the prefabricated elements.

For putting the invention into practice the employment of U sections as stiffening and connecting elements is particularly advantageous. In their dimensions same are preferably selected to be matched with the groove and tongue-like recesses and projections on the narrow sides to be connected of the prefabricated elements and/or the thickness of the core elements of the prefabricated elements. It is in this manner that the U sections may be exactly fitted in the groove-like recesses or may be arranged so that their limbs fit around the tongue-like projections. Moreover the limbs of the U sections may in accordance with the invention fit into the intermediate spaces between the core element and the surface element of the prefabricated element. These intermediate spaces are either already provided in the course of manufacture of the prefabricated element or are produced during manufacture the connection by insertion of the reinforcing and connecting elements. If, for example, prefabricated elements are employed, which are made from a foam board of PU, or PSD foam material, or if upright mineral wool is available as a core element and a plaster-cardboard sheet, it is possible for the interface between the core element and the face element, to be for example constituted by a bonding layer, to be readily broken by the insertion of, for instance, a metallic U section.

The universal application of the U sections is rendered possible because they are in accordance with the invention able to be adapted to a plurality of different uses, for example on the building site in a simple manner. Thus it is possible for the limbs of the U sections to be so cut that the portions of the limbs may be bent outward. The lugs so formed are then preferably bent so far outward that they are in the same planes as the base of the U sections. The lugs so formed project past the prefabricated elements, when the U section prepared in this manner is arranged on a prefabricated element. The projecting lugs may then with advantage be employed for the fastening of the stiffening and connecting element to the wall, ceiling or, respectively, floor of the room. Furthermore it is possible, in accordance with one particular form of embodiment, for such lugs to be also separated from the U section, so that a recess results at the corresponding limb of the U section. This recess then renders possible easier access to the base piece of the U section. If in the case of such stiffening and connecting element, which has inserted into the prefabricated element, at the position of the recess a similar recess is provided at the point of the recess a similar recess is provided in the surface element, access will be possible in the assembled state to the base surface of the U section, even if the prefabricated element terminates at a side, at which the section has been arranged, is flush with a room wall or, respectively, the floor or ceiling. Using such access, produced in this manner, to the base of the U section fastening of the U section to a wall, floor or ceiling of a room is possible without projecting lugs or visible fastening elements making an ugly optical impression during connection of a prefabricated element to a room wall or, respectively, floor or ceiling, if after fastening the recess is closed by simple plastering, for example. This special embodiment of the present invention renders possible not only rapid and economic but also a neat and aesthetically pleasing arrangement of the prefabricated parts in a room.

In a further embodiment the limbs of the U section are so cut that the U sections may be bent at an angle. This is advantageous for the design of door and window apertures in outer and separating walls or openings between stories or for the reinforcement of corners of the prefabricated elements.

In a similar manner it is possible to produce an oblique connection between prefabricated elements together or for an oblique connection of a prefabricated element to a room wall or, respectively, floor or ceiling the U section employed can be so cut that it is able to be bent about an axis perpendicular to the base surface. The parts arranged at an angle to one another of a U section prepared in this manner may then in a known fashion be connected with the prefabricated elements and the room walls or, respectively, floor or ceiling. Preferably, this is performed by connecting the base of the U section by fastening element such as screws and screw anchoring plugs with the room wall or, respectively, floor or ceiling and the limbs of the respective U section parts fit into the intermediate spaces between the prefabricated elements to be connected, which are produced between the core elements and the surface elements by insertion of the limbs.

Thus in a simple, rapid and reliable fashion by the employment of a U section, which in its dimensions is matched to the prefabricated elements employed, a great variety of reinforcement and connection functions may be performed. For this purpose the U section only has to be adapted in length to the different purposes and/or modified in a simple manner, even on the building site for example. In the ideal case it is however only necessary to stock one type of U sections on the building site with a single uniform length, which is then suitably processed on erection of the partition. Preferably conventional steel sections will be employed as the U sections, since same possess adequate rigidity and flexibility. As an fastening means it is possible for conventional screw, bolts and screw anchoring plugs to be used.

In order to optimize the stiffening and connecting properties it is naturally possible to utilize U sections with different dimensions. This may for example be the case when prefabricated elements with vertical and horizontal channels or, respectively, transversely and longitudinally extending channels are employed, since then there is the advantage of using U sections for the connection of the prefabricated elements, such U sections not extending for the entire thickness of the prefabricated elements so that horizontal or transverse channels are not blocked by the stiffening and connecting element. In this case it is then advisable to provide U sections with two different dimensions so that the U sections with the one dimension may be utilized as a stiffening and connecting element for the prefabricated elements amongst themselves and the other U sections with the other dimension may be employed for the application of the prefabricated elements to the wall, ceiling or, respectively, to the floor. Here as well there is however always the advantage of a small number of different components.

In one particularly preferred embodiment, when for example extremely stiff requirements apply as regards the stiffness and strength of the room delimiting means or, respectively, the connections of the prefabricated parts, it is furthermore possible for boards to be employed as further stiffening and connecting elements. This will be the case for example when U sections are used as reinforcing and connecting elements, which essentially do not encompass the full thickness of the prefabricated element, for example to leave channels exposed. In the case of this particular working embodiment of a room delimiting means it may be necessary for the additional boards to be arranged as stiffening and connecting elements on the side of the prefabricated wall elements, on which the exposed channels run. In this case the boards, in a manner similar to the limbs of the U sections, are fitted into the intermediate spaces between the core elements and the surface elements of the prefabricated elements to be connected. The boards may then in a similar manner to the U sections be connected by connecting means such as screws and bolts to the surface elements.

If the invention is employed for the erection of a story ceiling it is then an advantage, more particularly if the length of the prefabricated elements does not extend over the full width of the room, to use the U sections as ledge elements for the prefabricated elements as well. In this case the U sections are attached resting against the wall or athwart the room and the prefabricated elements are arranged in the previously described manner, that is to say for instance with the intermediate spaces between the core element and the surface element accommodating the limbs of the U section, on the U section. If in the case of such a design two U sections resting against each other are necessary, same may naturally be replaced by a H section or girder.

The invention thus provides a method which is particularly advantageous because of the saving in time and costs, which makes it possible to erect a sturdy room delimiting means using but a few components, starting with prefabricated elements.

In the following the characteristics and features of the present invention will be described in detail with reference to the accompanying drawings, which show preferred embodiments, which are all purely diagrammatic representations.

BRIEF DESCRIPTION OF THE DRAWINGS

FIG. 4 shows a perspective elevation of a U section (a) and of U sections (b and c) prepared in accordance with the invention.

FIG. 5 shows a perspective view (a and c) and a plan view (b and d) of U sections bent in accordance with the invention.

DESCRIPTION OF THE PREFERRED EMBODIMENTS

Figure 1:
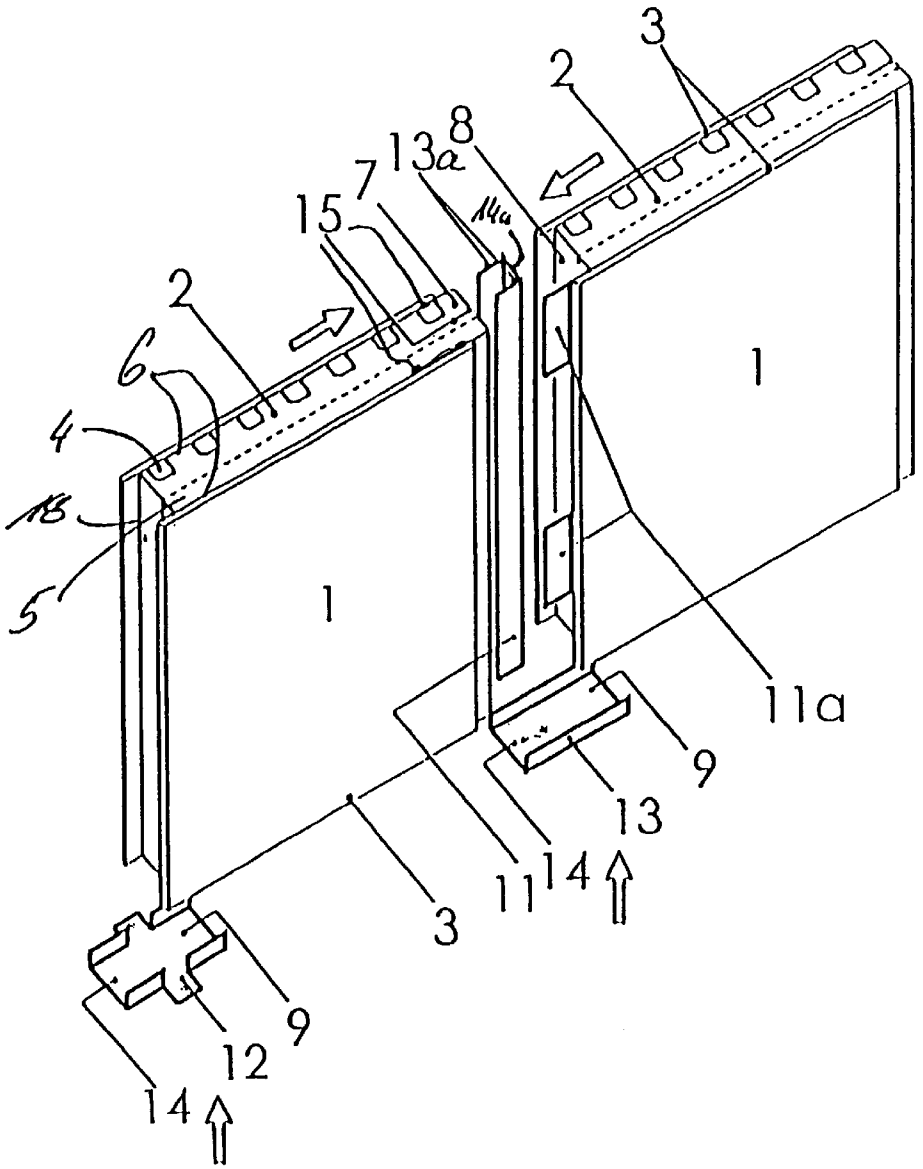
FIG. 1 is a perspective elevation of the components employed in the method of the invention and of the arrangement in relation to each other in accordance with the invention.

In an exploded perspective view FIG. 1 shows an embodiment of a room delimiting means. In this case prefabricated elements 1 are employed, which on one of their narrow sides 18 have a groove 8 extending for the thickness of the core element 2 and on the opposite narrow side a corresponding tongue element 7. It is however of course to be understood that the use of other prefabricated elements 1 would be possible as described later on. As illustrated in FIG. 1 the stiffening and connecting elements 9, 11 and 11*a* are arranged on the prefabricated elements 1, U sections 9 and 11 being essentially employed as stiffening and connecting elements, which here only essentially differ as regards the width of their base surfaces 14 and 14*a*. In addition it is possible to utilize boards 11*a*, if same are necessary.

During the assembly of the prefabricated elements 1 to produce a room delimiting means the prefabricated elements 1 are arranged with their longitudinal narrow sides 18 facing each other and are inserted into each other so that the groove and tongue-like elements 7 and 8 fit together. For stiffening the prefabricated elements 1 and for producing a connection between these prefabricated elements 1 a U section 11 is so moved between the prefabricated elements 1 to be connected that the base face 14*a* of the U section 11 fits into the recess 8 in the one prefabricated element 1 and the limbs 13*a* of the U section 11 fit around the tongue-like projection 7 on the other prefabricated element 1. In the illustrated position the projection 7 is however not completely encompass and in fact one limb 13*a* of the U section 11 fits into an intermediate space 15, which is arranged generally in the middle of the core element 2. The other limb of the U section 11 fits into a further intermediate space 15 between the core element 2 and one of the surface elements 3, which is for example formed because on fitting the parts into each other the limb 13*a* of the U section 11 releases the connection between the core element 2 and the surface element 3 at the connection face 6 as for example due to knocking the U section 11 into the narrow side 18.

A U section 11 fitted between the prefabricated elements 1 improves the stiffness of the prefabricated elements 1 and of the hold between the prefabricated elements 1 placed in a row and simultaneously produces a simple connection between the prefabricated elements 1, since as needed fastening elements 10 (not illustrated, see FIGS. 7 through 10), preferably screws (self tapping screws or plasterboard screws) or bolts may be inserted through the surface elements 3 of the adjacent prefabricated elements and through the respectively underlying limbs 13*a* of the inserted U section 11. It is in this manner that the groove and tongue-like connection between the prefabricated elements 1 is additionally secured.

With the illustrated use of prefabricated elements 1 with horizontal and vertical or, respectively, longitudinally and transversely extending conduit channels 4 and 5 the U section is suitably adapted, for example on the basis of recesses or openings, or the U section 11 extends, as in the illustrated case, only for part of the thickness of the prefabricated element or the narrow side thereof 18 so that the horizontal conduit channels 5, or those extending the prefabricated element are not blocked by the fitting in place of the U section 11. In this particular embodiment it is possible, should it be necessary for reasons of strength, for boards 11*a* to be arranged on the surface element side, on which horizontally or, respectively, transversely extending channels 5 are arranged, which boards just like the limbs 13*a* of the U section 11 on the other side of the prefabricated element may be fitted in the intermediate spaces 15 between the surface element 3 and the core element 2 on the two prefabricated elements 1 to be connected. By sticking screws 10 (not illustrated, see also FIGS. 7 through 10) or the like through the surface elements 3 and the board 11*a* underneath same this connection may be secured in the same fashion.

It is of course possible in such cases to do without any additional U section 11 or an additional board 11*a,* if the strength of the connection and of the prefabricated elements is sufficient.

For the fastening of the prefabricated elements 1 on a room wall or, respectively, a floor or ceiling or for connection of prefabricated elements 1 without horizontal or transversely extending conduit channels 5 a U section 9 with different dimensions to that of the U section 11 is so utilized that its limbs 13 fit right around the entire core element 2. As shown the U section 9 is so arranged like the U section 11 that the limbs 13 fit into the intermediate spaces 15 between the surface elements 3 and the core element 2.

Figure 2:
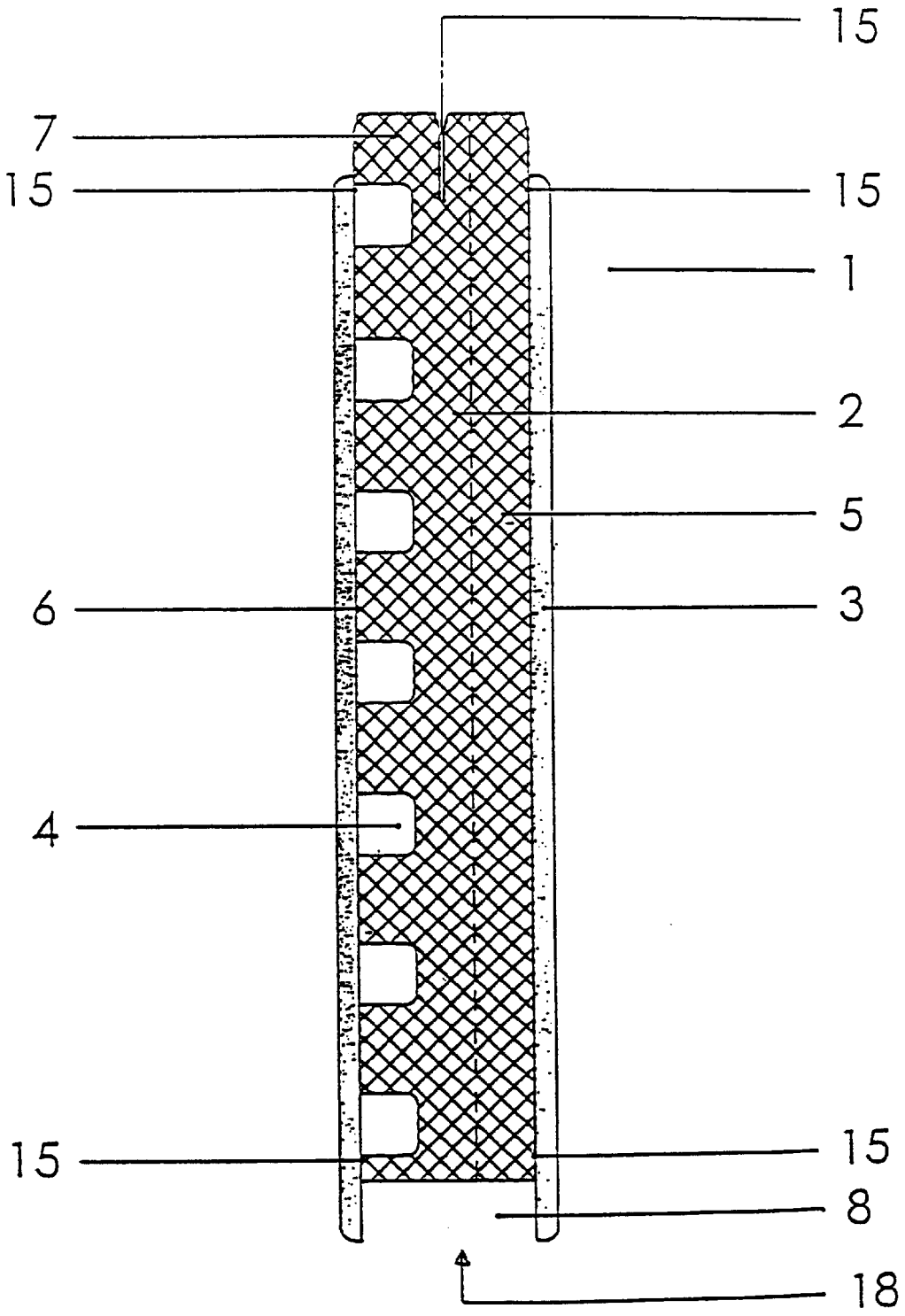
FIG. 2 shows a cross section taken through a prefabricated partition element.
Figure 3:
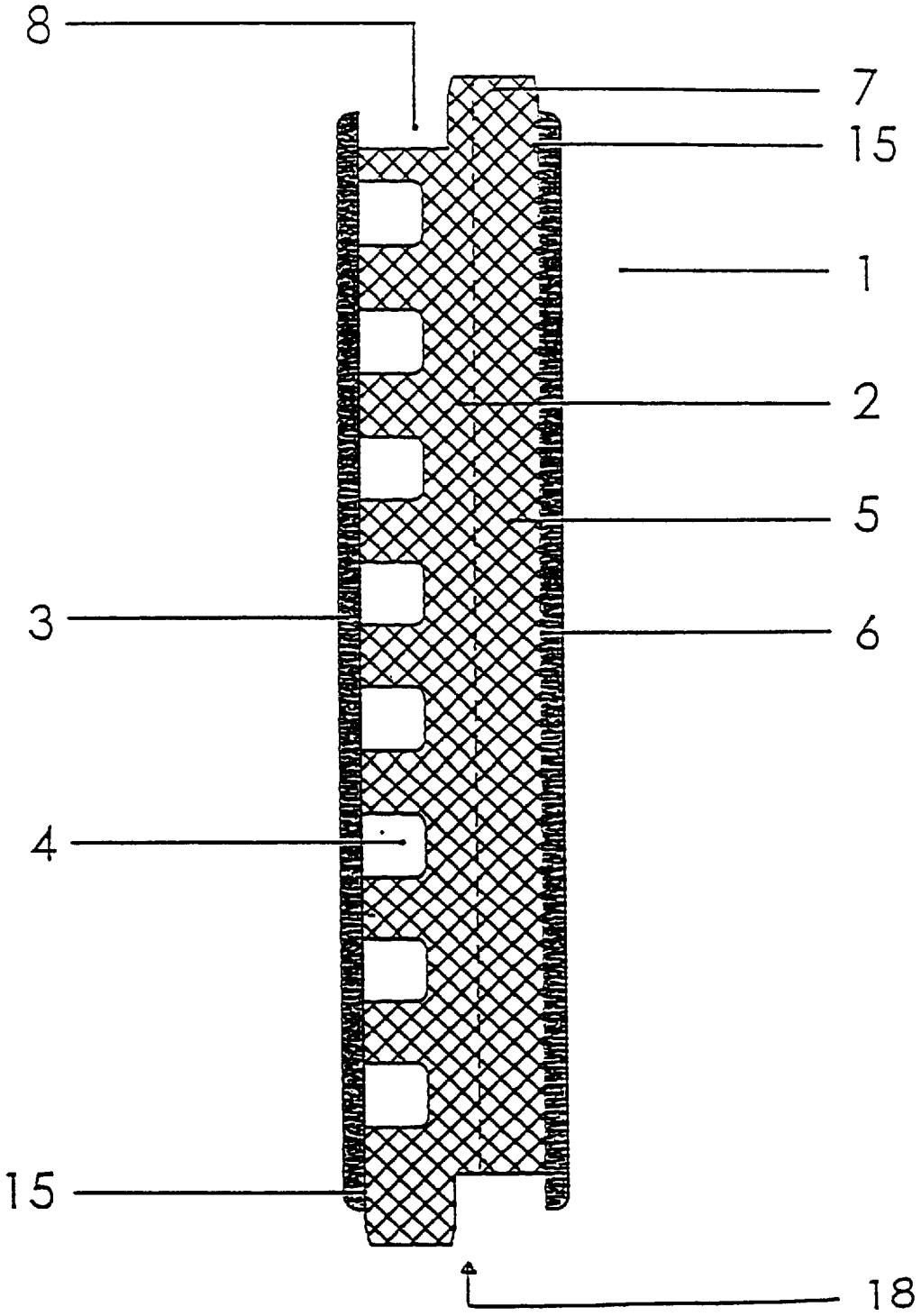
FIG. 3 shows a such as taken through a prefabricated partition element with a stepped fold.

In FIG. 2 and FIG. 3 a respective cross section taken through prefabricated elements is shown, such elements preferably being employed for the erection of room delimiting means. Here there is a detailed representation indicating that the prefabricated element 1 is composed of a core element 2 and preferably two surface elements 3. The longitudinally extending channels 4 and transversely extending channels of the prefabricated element 1 are in this preferred embodiment formed in the oppositely placed side faces of the core element 2. Owing to the surface elements 3, which respectively possess a connecting face 6 with the core element, the channels 4 and 5 are shut off from the outside. At the narrow sides 18 of the longitudinal side of the prefabricated element 1 groove and tongue-like elements 7 and 8 in the form of a projection 7 and a recess 8 are provided, which extend over the full width of the core element 2 (FIG. 2) or merely over a part (FIG. 3) thereof, whereas the two other narrow sides are essentially plain.

Figure 6:
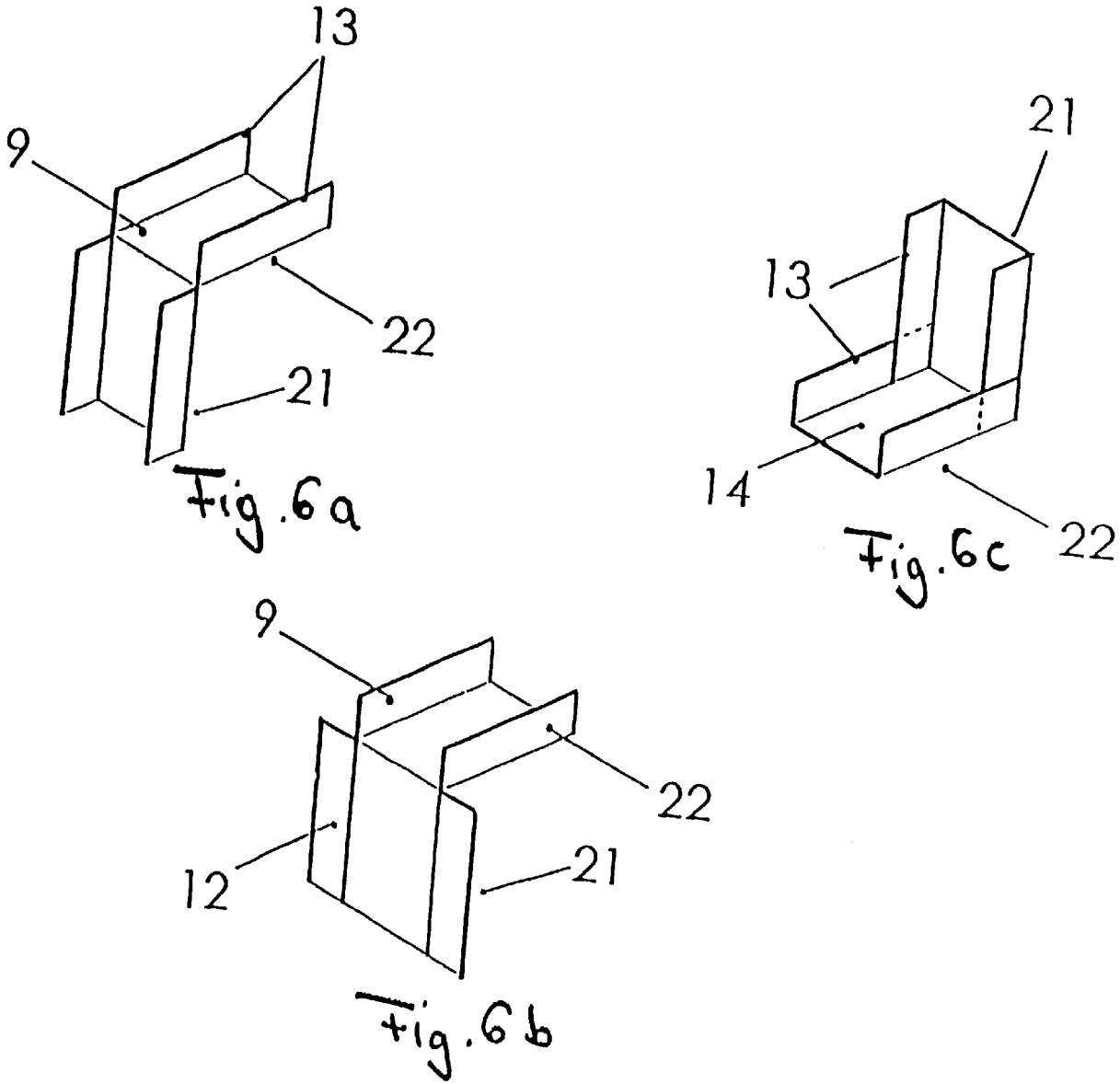
FIG. 6 shows perspective views of U sections bent in accordance with the invention.

FIGS. 4 through 6 indicate how the U sections 9, utilized as stiffening and connecting elements may be adapted for different purpose of use. Thus it becomes, as indicated in FIG. 4, possible to cut into the limbs 13 to form lugs 12, which are bent into the plane of the base 14 in order to serve for fastening to the wall, ceiling or, respectively, floor (FIG. 4*b*). In a further embodiment (FIG. 4*c*) the U sections 9 are so processed that the lugs 12, which were produced by cutting the limb 13, are removed so that recesses 16 are produced in the limbs 13. If a U section worked in this manner is moved so that its limbs 13 fit into the intermediate spaces 15 of the prefabricated elements 1, it is the possible, given a suitable arrangement of recesses in the surface element 3, to provide a passage through to the base 14, via the recess 16, of the section, which passage is employed to insert fastening means for the connection of the base 14 of the U section 9 with walls, the floor or the ceiling of the room. The recesses then produced in the surface elements may, after assembly, be filled in a simple fashion with plaster, for example, so that in the case of this preferred type of fastening no visible projecting lugs 12 are left on the walls or on the floor and ceiling of the room.

FIG. 5 shows a further preferred embodiment of the U section 9 able to be employed as a universal stiffening and connecting element. By cutting a limb 13 and the base 14 of the U section 9 it is possible to produce a bend in the U section 9 as related to the longitudinal axis of the U section 9 in the plane of the base 14 by bending, such bend serving to render possible an angular arrangement of the prefabricated elements 1 in relation to one another or in relation to the wall, the floor or the ceiling. In this case the bend of the U section 9 may be so produced that the base faces 14 of the two U section parts overlap (FIG. 5*c* and FIG. 5*d*) or have a gap between them (FIGS. 5*a* and 5*b*). It is naturally necessary, in the case of such an angular arrangement of the prefabricated elements 1, to work on them using a suitable miter cut in the side coming into question so that the sides to be connected or, respectively, the side, is or are exactly flush with any already present room delimiting means. This is something which may be carried out by a man in the art using well known methods.

FIG. 6 shows examples of U sections 9, which have been worked in accordance with a further embodiment of the present invention. By cutting the two limbs 13 of a U section 9 it is possible for the base 14 of the U section 9 to be bent or angled. This means that angular U sections 9 are produce, which for example may be fitted in the corners of a door or window frame or an opening through a story of a room delimiting means made up of the prefabricated elements 1 (see FIG. 11 below). The bent U section 9 possesses a vertical part 21 and a horizontal part 22, which may be so arranged in relation to each other that their limbs 13 overlap (FIG. 6*c*) or have a gap between them (FIG. 6*a*). Furthermore it is possible for the limb parts 13 to be bent completely or partially into the plane of the base 14 in order to form lugs 12.

Figure 7:
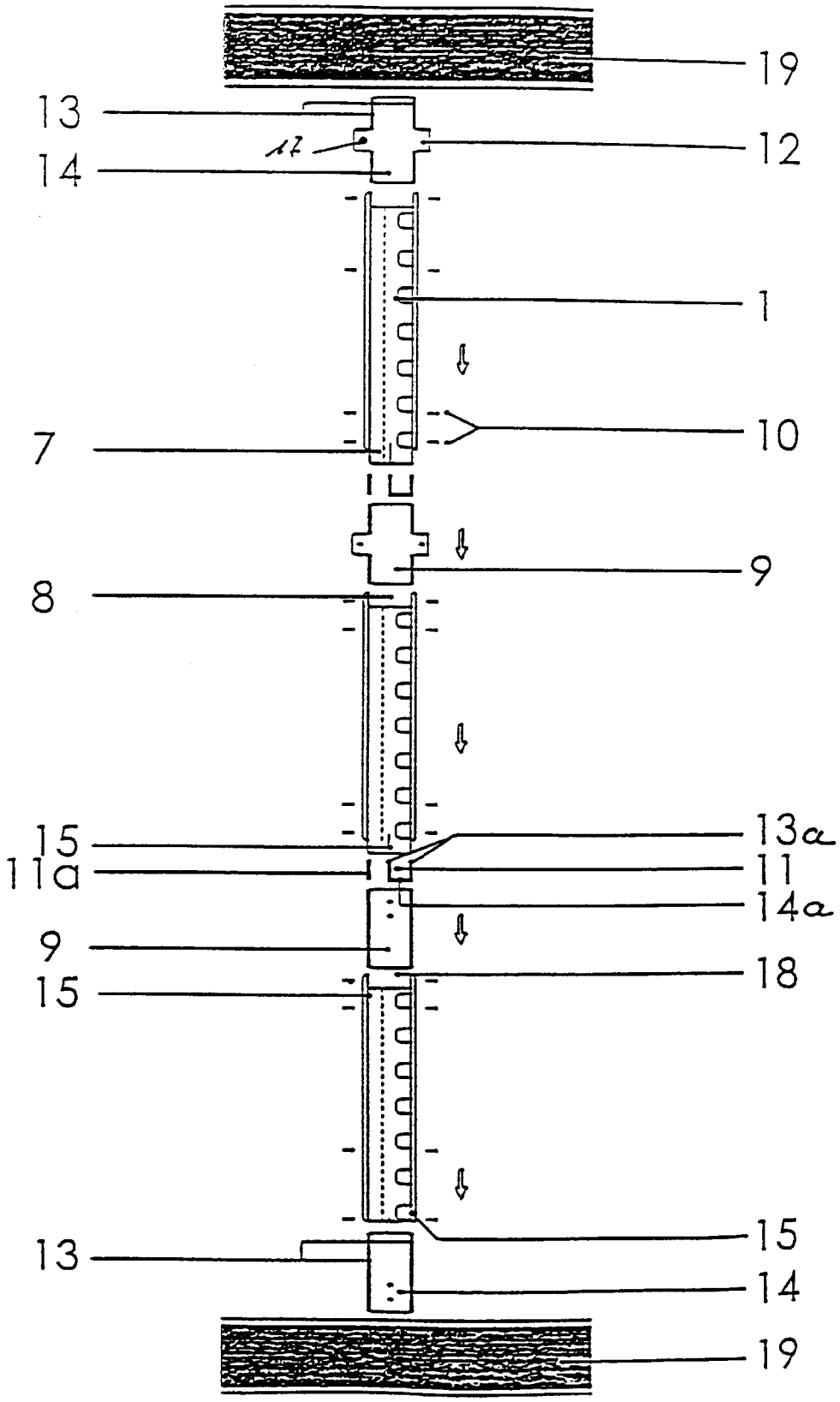
FIG. 7 shows a cross section taken through a plurality of prefabricated partition elements, the arrangement of the prefabricated elements, stiffening and connecting element and fastening elements being illustrated during the erection of a room delimiting means.

FIG. 7 shows a cross section taken through a room delimiting means in accordance with the invention arranged between two pre-existing room delimiting means 19, i.e. a wall, ceiling or floor, said delimiting of the invention being made up of prefabricated parts 1. Here in addition the arrangement and use of the above mentioned components the arrangement and use of the fastening means 10 will be clear. In the case of the room delimiting means illustrated U sections 9 and 11 of different width are utilized. While the U sections 9 extend over the full width of the core elements 2 and their limbs 13 surround the entire core element 2, the U sections 11 are less wide so that their limbs 13*a* only surround a part of the core element. The U sections 9 are consequently employed for the fastening of the prefabricated element 1 to a pre-existing wall, ceiling or floor 19, whereas the U sections 11 serve for stiffening and connecting the prefabricated elements 1 themselves together. In the case of embodiment depicted in FIG. 7 the U sections 9 are employed for the connection with a wall or, respectively, floor 19, which in this case is in the plane of the drawing. Here the above described designs of the U sections 9 are employed. Thus in the top part of FIG. 7 U sections are indicated, which have lugs 12, by means of which the U sections 9 may be connected with the wall or, respectively, ceiling or floor 19. For this purpose fastening means 17, such as screws, bolts, screw anchoring plugs and the like, are provided on the lugs 12. Alternatively it is possible for the fastening means 17 to be arranged on the base face 14, U sections 9, which are provided with recesses 16, rendering possible access to the base 14 even if there is a pre-existing prefabricated element 1 in place, if a suitable recess is provided in the surface element 3 of the prefabricated element 1. In addition to the fastening of the U sections 9 using screws, screw anchoring plugs and the like it is also to possible employ other suitable connecting methods, such as bonding. The stiffening and connecting elements 11 and 11*a*, which are arranged between adjacent prefabricated elements 1 in accordance with the above description, may if required, be additionally secured using fastening element 10 on the prefabricated elements 1. Here it is also possible to use, more particularly, screws, bolts and preferably self-tapping screws as fastening means. By means of the fastening means 10 there is , more particularly, the creation of a strong connection between the surface elements 3 and the limbs 13*a* of the U section 11 or, respectively, the boards 11*a*. It is naturally possible for the U sections 9, which preferably serve for fastening of the prefabricated elements 1 to a wall or ceiling or, respectively, floor 19, to be additionally attached in the same manner, i.e. therefore using fastening means 10, by the limb to the surface elements 3 of the prefabricated elements 1.

Figure 8:
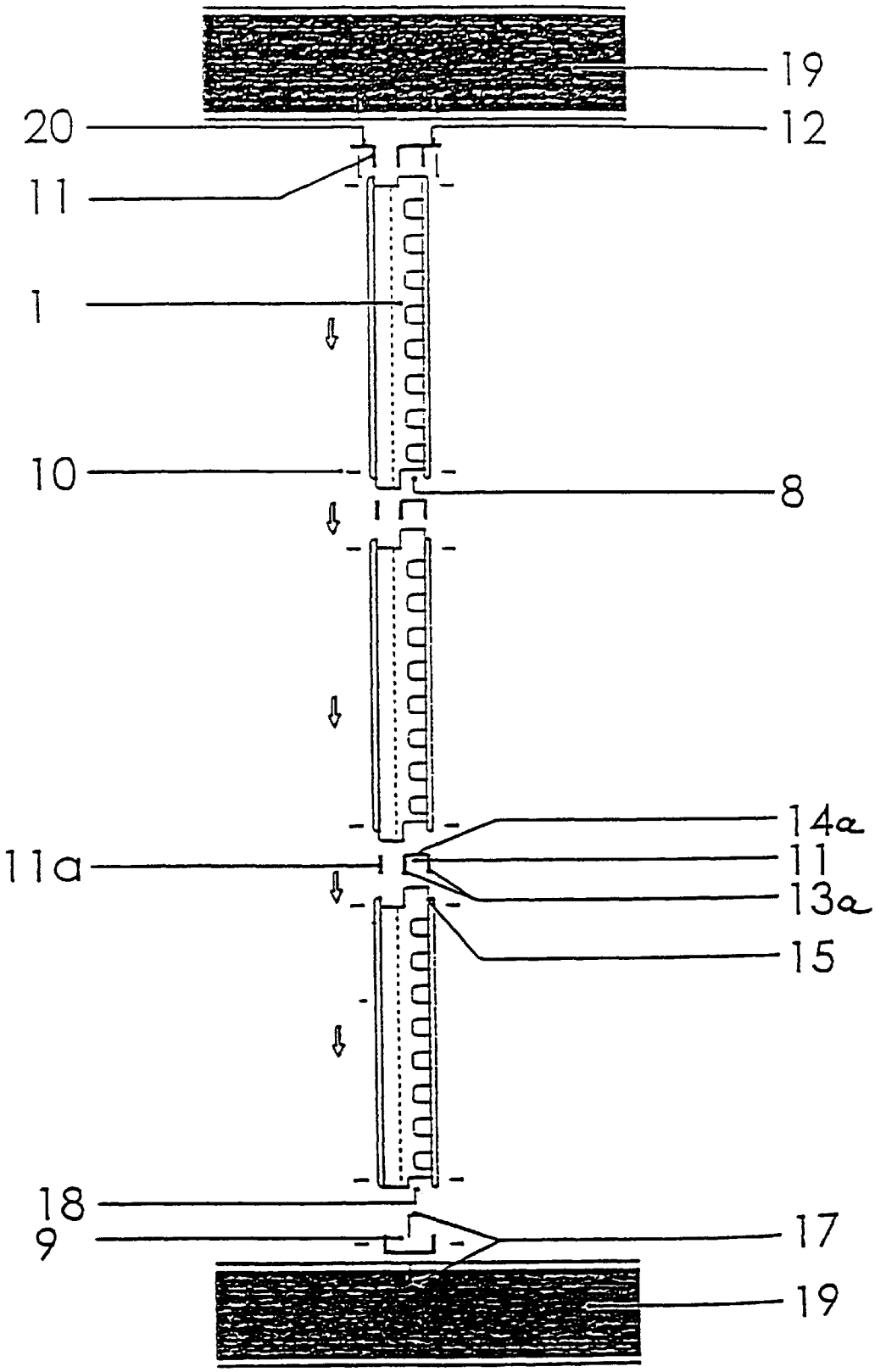
FIG. 8 shows a cross section taken through a plurality of prefabricated partition elements, the arrangement of the prefabricated elements, stiffening and connecting element and fastening elements being depicted during the erection of room delimiting means with prefabricated elements having a stepped fold.

At the top FIG. 8 shows a further embodiment, in the case of which a U section 11 is utilized for the fastening of a prefabricated element 1 to wall or floor or, respectively, ceiling 19, which extends over only part of the thickness of the prefabricated element 1 and accordingly, for example, in the case of a prefabricated element 1 with vertical and horizontal or, respectively, transversely and longitudinally extending channels 4 and 5, does not block the horizontal or, respectively, transversely extending channel 5.

If exceptionally an additional fastening of a prefabricated element 1 to the room wall 19 is necessary, it is then possible to simply bend a board 11*a* partly to form an angle so that a limb 20 of the angle is connected in a known fashion with the room wall 19, whereas the other limb of the angle is fitted into the intermediate space 15 of the prefabricated element 1 in a manner which is also known.

Figure 9:
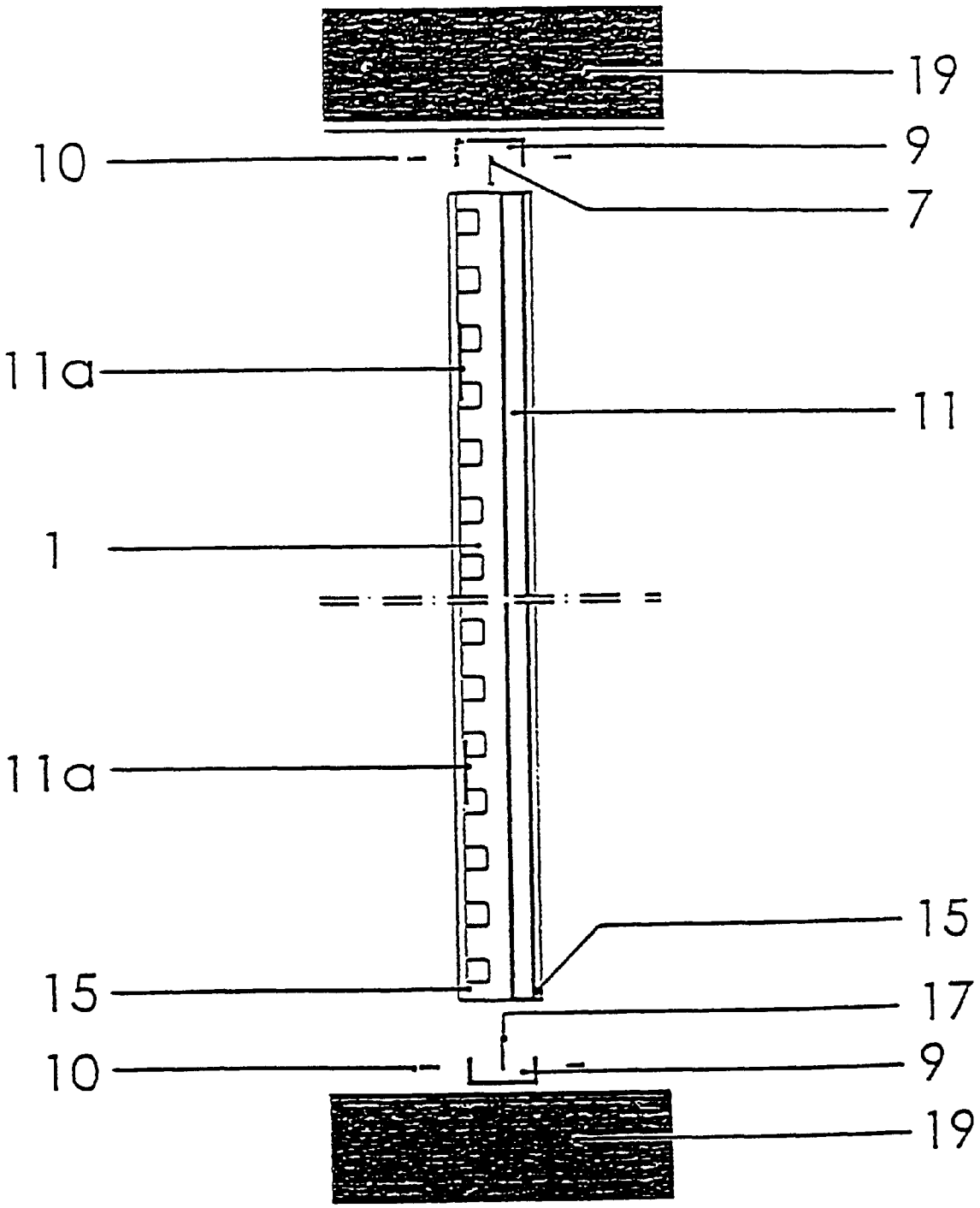
FIG. 9 shows a cross section taken perpendicularly to the views of FIGS. 7 and 8 through a partition wall/prefabricated elements, the arrangement of the prefabricated element, stiffening and connecting elements and the fastening elements being illustrated in the course of the erection of the room delimiting means.

FIG. 9 shows a section taken perpendicularly to the views of FIGS. 7 and 8 in the case of which the connection of the prefabricated elements 1 with the room ceiling or, respectively, floor or walls 19 by means of the U sections 9 is visible. As shown in FIG. 9 at the bottom and, respectively, at the top, a U section 9, which is adapted to the thickness of the prefabricated element 1, is firstly attached to the room wall, floor or, respectively, ceiling 19, preferably by means of screw anchoring plugs and screws to the room wall, floor or, respectively, ceiling 19. The first prefabricated element 1 is inserted into the limbs 13 of the U sections 9 attached to the room delimiting means 19 so that the limbs 13 assume positions in the intermediate spaces 15 (see on this point the bottom of FIG. 7). In the case of the use of prefabricated elements 1 with tongue-like projections 7, which project past the surface elements 3, it is necessary for the prefabricated element 1 to be prepared prior to fastening in a suitable manner, for example by sawing off with a keyhole saw so that the surface elements 3 of the prefabricated element end flush with the room wall 19. If U sections 9 are not utilized, which extend over the full length of the room delimiting means to be erected, then after this in a conventional manner two further U sections 9 on the room floor, ceiling or, respectively, wall are inserted into the intermediate spaces 15 in the first prefabricated element 1 on the opposite narrow side 18 as far as half the U section 9 and if required again secured with fastening means 17 to the room walls 19. At a position adjacent to the first prefabricated element 1, which is now firmly secured in place, the second prefabricated element 1 is so arranged that the tongue-like projection of the one prefabricated element fits into the groove in the other prefabricated element 1 and the limbs 13 of the already secured U sections 9 fit into the intermediate spaces 15 of the second prefabricated element. The limbs 13 of the U sections 9 may, in the case of this type of connection, be joined using screws 10 or the like to the surface elements 3.

Figure 10:
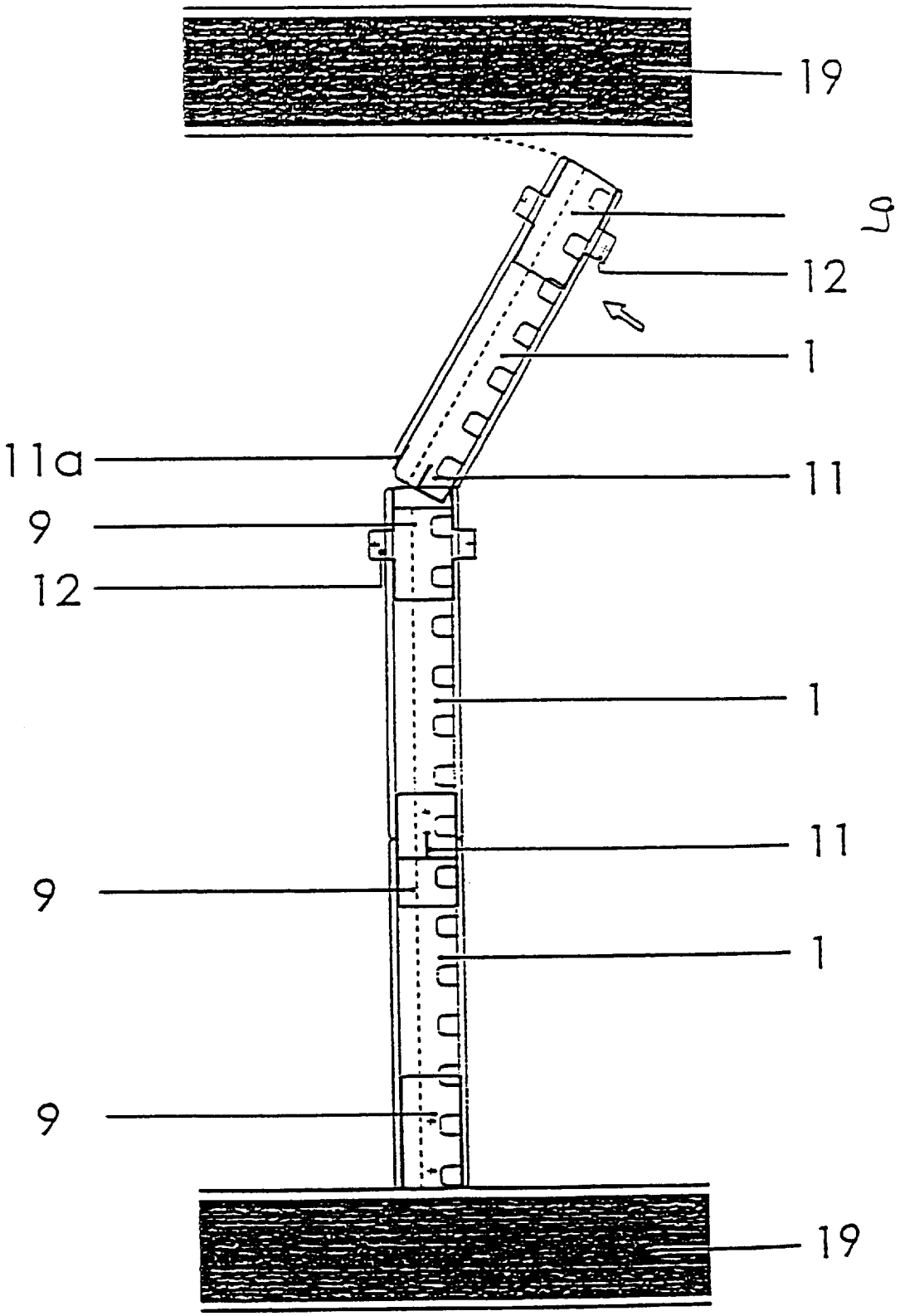
FIG. 10 shows a cross section taken through a practically completed room delimiting means.

FIG. 10 shows, in a manner similar to FIG. 7, a section taken through a plurality of joined-together prefabricated elements 1. In particular this FIG. 10 shows the method which is employed on the insertion of the last prefabricated element 1 in a room delimiting means. The prefabricated element 1, which prior to insertion is cut to the right length in a suitable manner, is provided on the narrow sides, which assume positions on the wall or, respectively, ceiling/floor 19, with the corresponding stiffening and connecting elements 9, 11 and 11*a*. By turning in the prefabricated element it may be arranged with an exact fit in the room delimiting means. For this purpose it is possible for the tongue-like projection 7 to be made oblique in some suitable fashion in order to facilitate turning in. After this the arrangement is stabilized by the application of the fastening means 10 and 17 in a simple manner.

Figure 11:
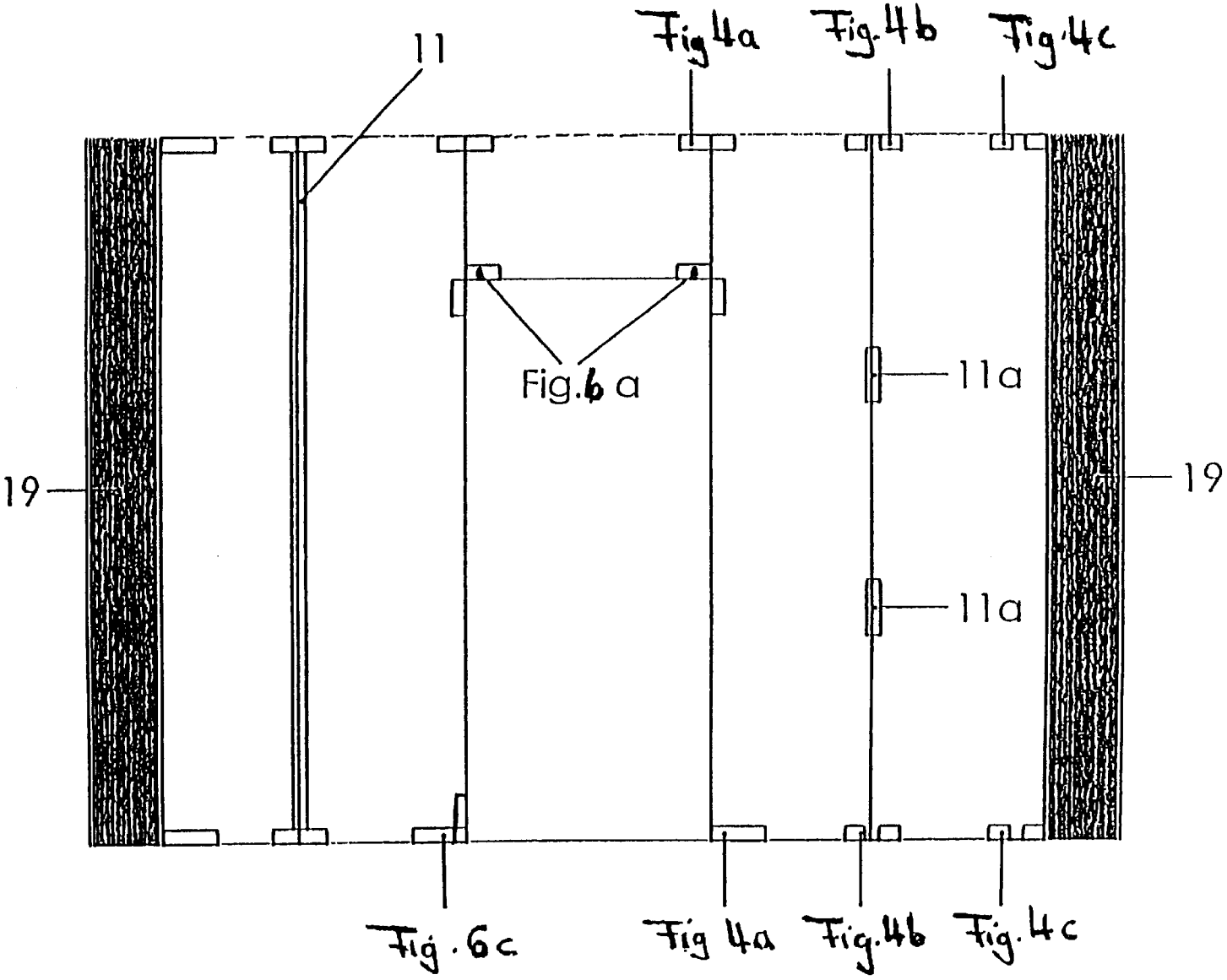
FIG. 11 is a lateral view of a room delimiting means of the invention.

FIG. 11 shows a side view of a room delimiting means in accordance with the invention. In this figure there is again a diagrammatic indication as to how the different components of the room delimiting means in accordance with the invention are arranged. Thus the drawing indicates that between two adjacent prefabricated elements 1 a U section 11 is arranged over the full height of the prefabricated elements 1, and in addition however furthermore boards 11*a* in section. Furthermore the FIG. 11 indicates the incorporation of the prefabricated elements 1 in the floor and ceiling using the differently designed U sections 9. Moreover a door opening is indicated, in whose corners at least partly bent U sections 9 are arranged FIG. 6*a*.

Figure 12:
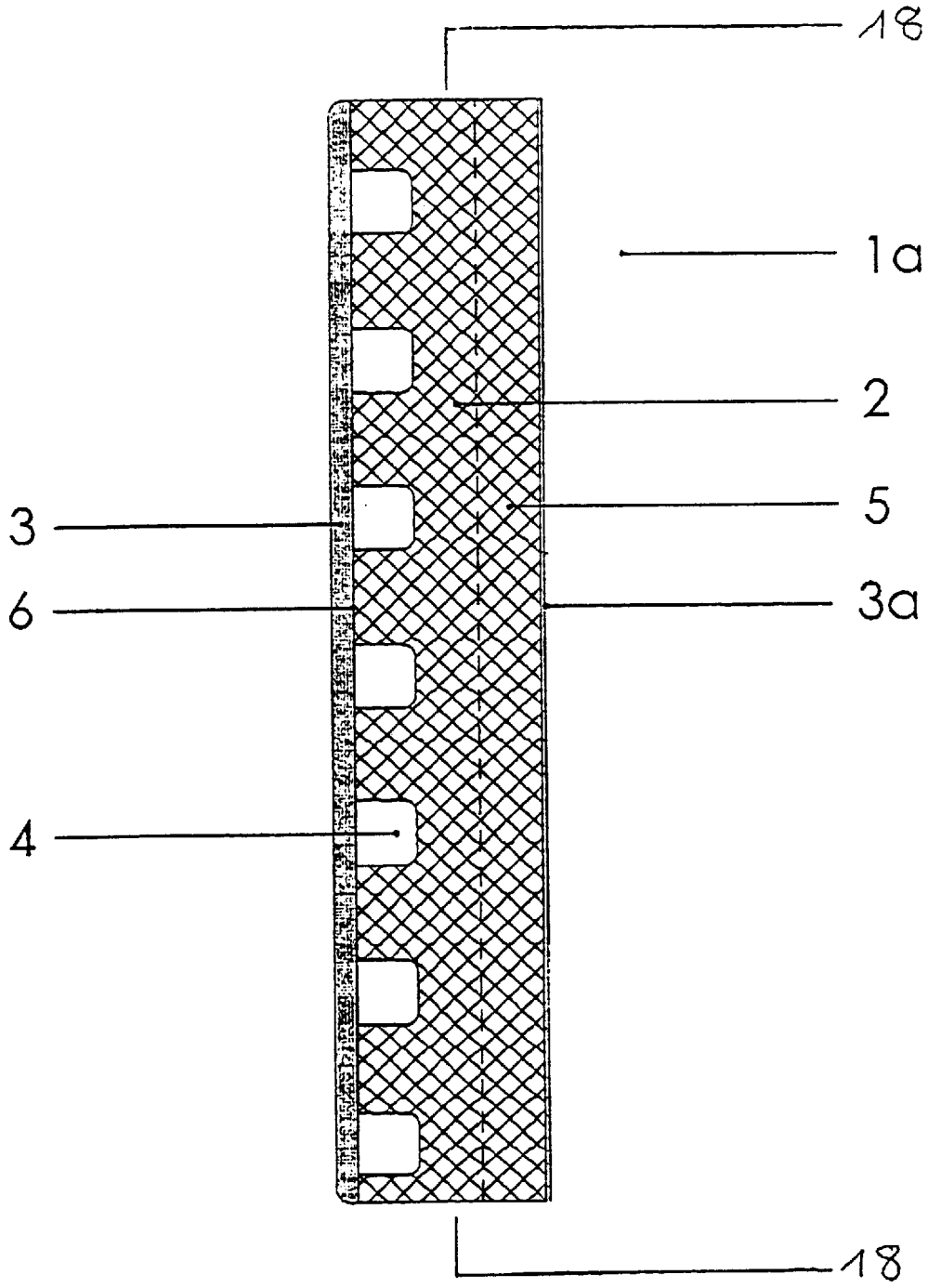
FIG. 12 is a cross section through a prefabricated wall element for a load-carrying or non-load carrying design for mounting planks on walls.
Figure 13:
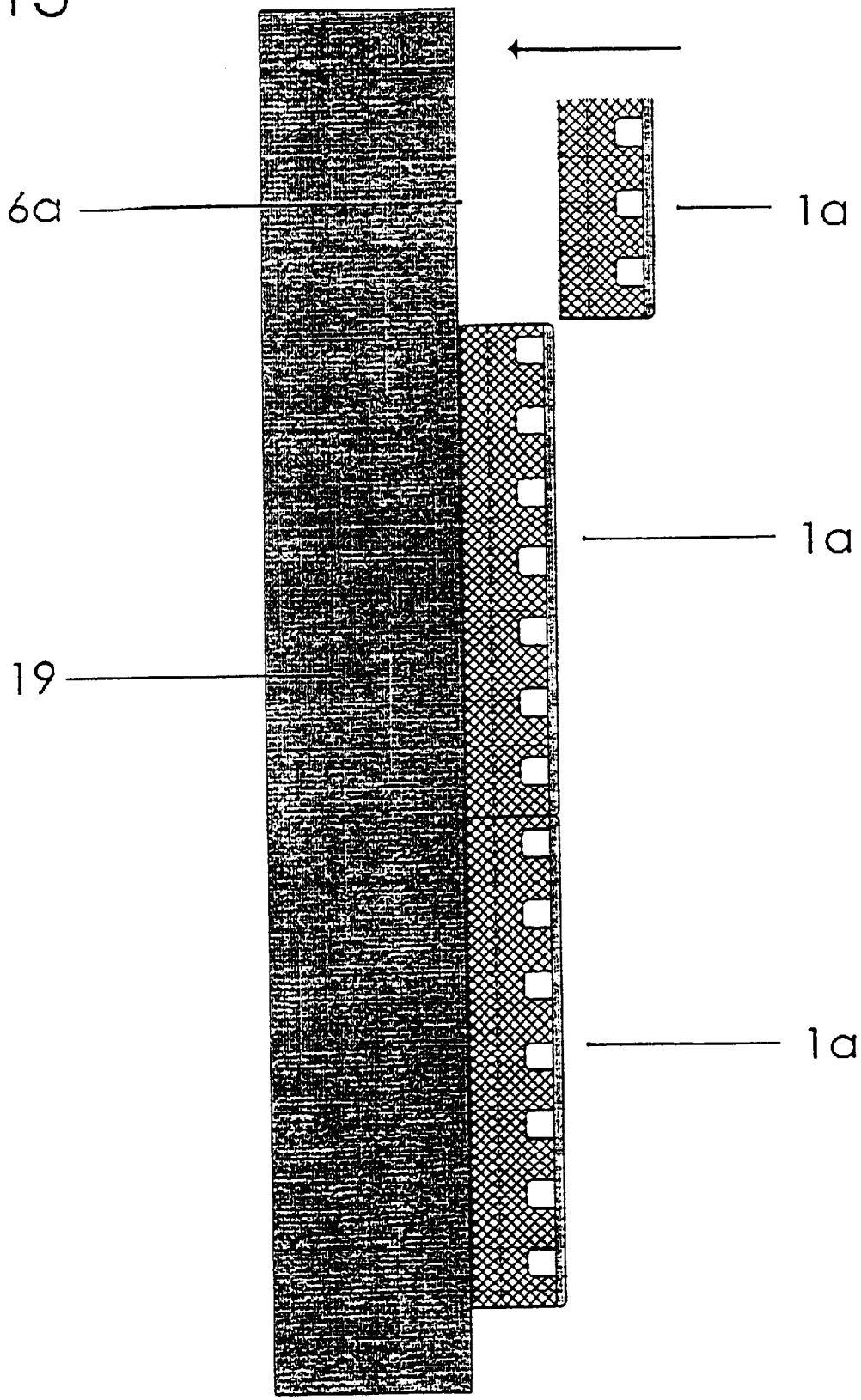
FIG. 13 is a cross section taken through a prefabricated wall element for mounting planks on walls with a pre-existing wall and an arrangement of the individual prefabricated wall elements.

FIG. 12 and, respectively, FIG. 13 show a horizontal cross section through a prefabricated wall element, which is preferably employed in the method in accordance with the invention for attaching planks to pre-existing outer walls or, respectively, walls in general. The prefabricated wall element 1*a* is composed of a core element 2 and preferably two wall surface elements 3 and, respectively, 3*a*. The vertical channels 4 and the horizontal 5 of the prefabricated element 1*a* are in this preferred embodiment formed in the oppositely placed side faces of the core element 2. By means of the wall surface elements 3 and, respectively, 3*a,* which each possess a connecting face 6 leading to the core element, the channels 4 and 5 are shut off from the outside. The vertical narrow sides 18 of the prefabricated floor elements 1*b* are preferably plain in form, though prefabricated wall elements are also provided having groove and tongue-like elements 7 and 8 in the form of a projection 7 and a recess 8, as described in connection with FIG. 1 and, respectively, FIGS. 2 and 3. For stiffening and connecting the prefabricated elements the method in accordance with the invention is employed using prefabricated elements. In a load-carrying design the connecting elements (for example steel U sections) assume a static function.

Figure 14:
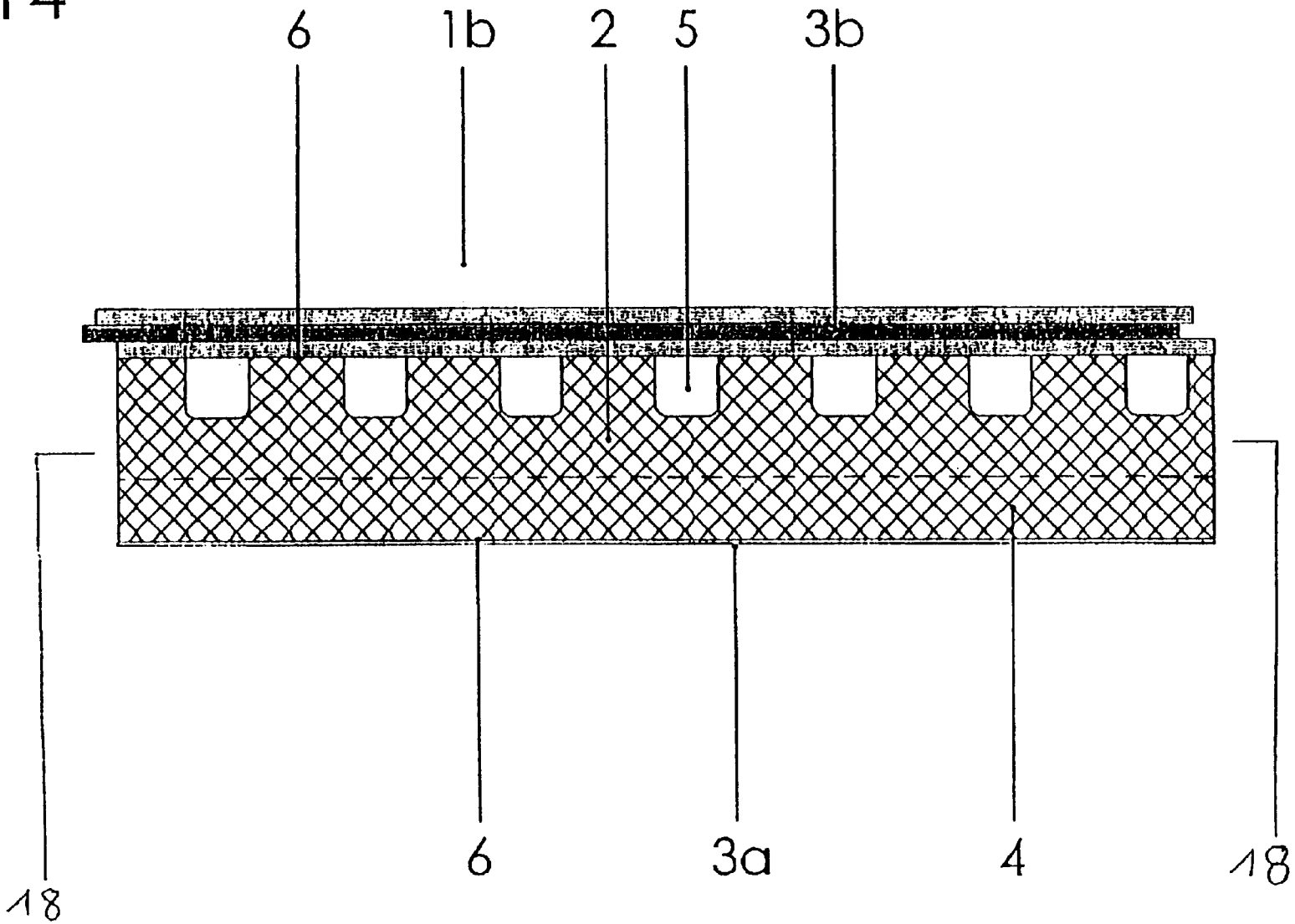
FIG. 14 is a cross section through a floor or prefabricated story element for the production of load-bearing story ceilings (prefabricated ceiling with longitudinal conductor conduits) or dry subfloors (dry screeded floor, with conductor channels "double floor"), which are load-bearing or not so.
Figure 15:
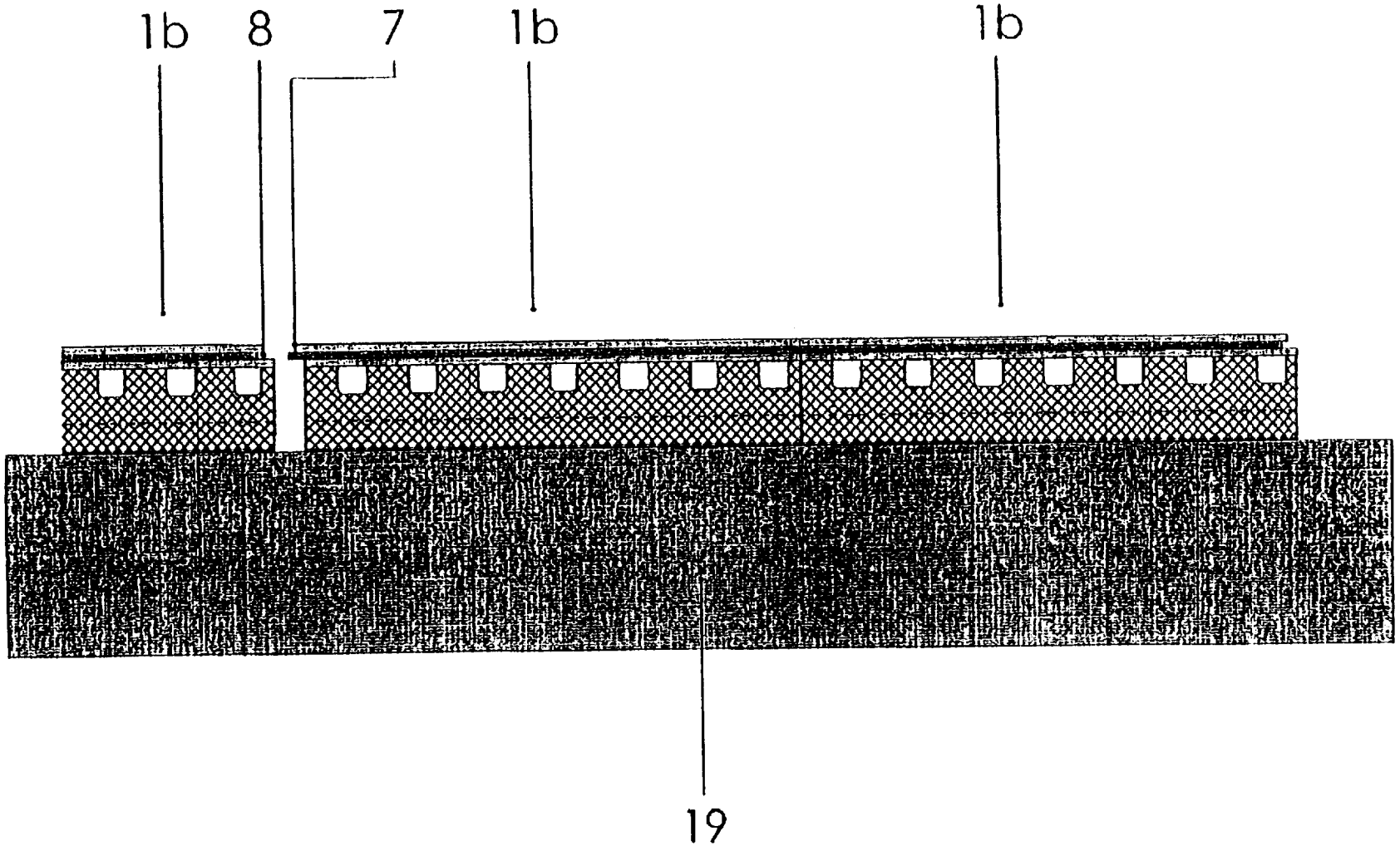
FIG. 15 shows a cross section through a prefabricated floor element (non-load bearing) for producing a dry subfloor (dry screeded floor, with conduits, "double floor")) on a pre-existing story ceiling (also possible in a load-bearing design).

In FIG. 14 and, respectively, FIG. 15 a horizontal cross section taken through a prefabricated floor element is indicated, which is preferably employed in the method of the invention for the production of prefabricated story ceilings or, respectively, for laying dry screed floor base on a pre-existing story ceiling 19. The prefabricated floor element 1*b* is composed of a core element 2 and preferably two floor surface elements 3*a* and 3*b*. The vertical (transversely extending) channels 4 and the horizontal (longitudinally extending) channels 5 of the prefabricated floor element 1*b* are in this embodiment formed in the oppositely placed side faces of the core element 2. The channels 4 and 5 are shut off from the outside by the floor surface elements 3*a* and, respectively, 3*b,* which each possess a face joining them with the core element. The floor surface element 3*b* has a groove and tongue-like design of the narrow side, which is bonded during laying. The vertical narrow sides 18 of the prefabricated elements 1*b* are preferably made plain, but however the invention also provides prefabricated floor elements with groove and tongue-like elements 7 and 8 in the form of a projection 7 and a recess 9 as shown in FIG. 1 and, respectively, FIGS. 2 and 3. For stiffening and connecting the prefabricated elements the method in accordance with the invention is utilized using prefabricated elements 1. In a load-carrying form the connecting elements (as for instance steel U sections or H sections) perform a static function.

Figure 16:
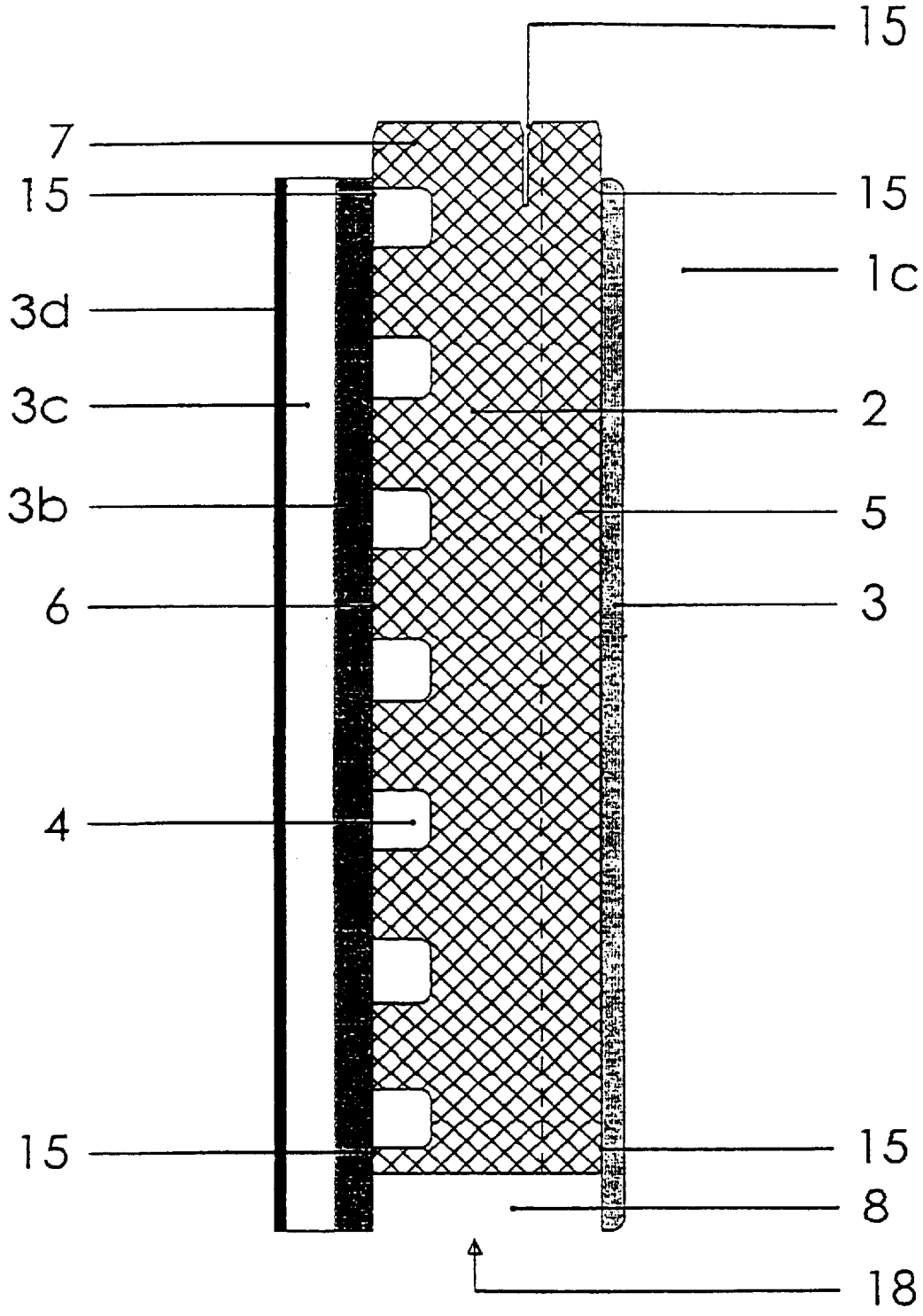
FIG. 16 is a cross section taken through an outer prefabricated wall element load-bearing and non-load-bearing designs.

In FIG. 16 a horizontal cross section taken through a prefabricated wall element is shown, which is preferably employed in the method of the invention for the erection of outer walls. The prefabricated wall element 1*c* is composed of a core element 2 and preferably provided with the wall surface elements 3, 3*b,* 3*c* and 3*d*. The vertical channels 4 and the horizontal channels 5 of the prefabricated element 1*c* in this preferred embodiment of the invention are formed in the opposite side faces of the core element 2. The wall surface elements 3 and 3*b,* which respectively have a face 6 leading onto the core element, shut off the channels 4 and 5 from the outside. On the narrow sides 18 adjacent to the longitudinal side of the prefabricated wall elements 1*c* groove and tongue-like elements 7 and 8 are provided in the form of a projection 7 and recess 8, which extends for the entire width of the core element 2.

For stiffening and connecting the prefabricated elements the method in accordance with the invention with prefabricated elements 1 is employed. In a load-carrying design the connecting elements (as for instance steel U sections or H sections) perform a static function.

As may be seen from the examples described the invention offers a multiplicity of different combinations of the components employed, which could not all be presented separately. It is however clear that a combination or only partial use of all the features indicated is possible for certain applications. Particularly it is also possible to employ the invention in combination with known connection and erection methods, as for example a simple groove and tongue-like connection, a bond and the like. Furthermore in the examples no attention has been paid to particular dimensions of the components, since same must obviously be adapted to the particular purpose of use. More especially, to take an example, the length of the U sections utilized may vary considerably dependent on the application. Preferably, U sections are therefore employed which may be cut down to the required length by the user on site.

The U sections 9 and 11 and, respectively, the boards 11*a* are preferably manufactured of metal and more particularly steel, although any other material could be considered which possesses the desired properties such as flexibility and sufficient rigidity.

What is claimed is:

1. A room delimiting means for new and semi-finished buildings or for incorporation in pre-existing rooms, said room delimiting means comprising:

modular prefabricated elements, each of said prefabricated elements comprising a core element and at least one surface element, at least one of said core element and said surface element including at least one of recesses and intermediate spaces therein, each of said prefabricated elements including groove and tongue-like recesses and projections on opposite sides for connecting one of said prefabricated elements with another of said prefabricated elements, said projections engaging corresponding recesses in an adjacent one of said prefabricated elements when said prefabricated elements are connected together;

stiffening and connecting elements attached to said prefabricated elements, said stiffening and connecting elements being configured to fasten to said sides of said prefabricated elements to at least one of stiffen said prefabricated elements, connect said prefabricated elements to a surface of a room and connect said one of said prefabricated elements with said another of said prefabricated elements, said stiffening and connecting elements being arrangable in said at least one of the recesses and the intermediate spaces to connect said prefabricated elements with said another of said prefabricated elements, the surface being at least one of a wall, a floor and a ceiling of the room; and fastening elements for connecting at least one of said stiffening and connecting elements to at least one of the surface and said prefabricated elements.

2. The room delimiting means as claimed in claim 1, wherein said prefabricated elements include spaced conduit elements, which are arranged at least one of longitudinally with respect to the prefabricated element and athwart the longitudinal direction of the prefabricated elements, the spaced conduit elements being configured to accommodate at least one of cables, installation material, and heating or cooling media.

3. The room delimiting means as claimed in claim 2, wherein said stiffening and connecting elements comprise a generally U shaped element which receives said tongue like projection and a generally straight element which inserts between said core element and said surface element, said first and second elements being positioned at said prefabricated elements in positions which are remote form said spaced conduit members in said prefabricated elements.

4. The room delimiting means as claimed in claim 1, wherein said stiffening and connecting elements comprise U sections, said U sections including limbs and base faces, said stiffening and connecting elements being attachable to the prefabricated elements such that said limbs of said U sections at least one of fit around said tongue-like projections, fit around said core element of said prefabricated elements, fit into an intermediate space in said core element, and fit between said core element and said surface element.

5. The room delimiting means as claimed in claim 4, wherein said U sections include at least one of lugs and recesses so that said U sections are attachable by fastening means on at least one of the lugs and the recesses.

6. The room delimiting means as claimed in claim 1, wherein said fastening elements comprise at least one of screws, bolts, bonds and screw anchoring plugs.

7. The room delimiting means as claimed in claim 1, wherein said stiffening and connecting means comprise boards, which are preferably configured to be able to be inserted in intermediate spaces between said core element and said surface element.

8. A method for implementing an individual prefabricated element of a room delimiting means, characterized in that for each individual prefabricated element said method comprises the following steps:

providing modular prefabricated elements which comprise a core element and at least one surface element, at least one said core element and said at least one surface element including at least one of recesses and intermediate spaces therein, each of said prefabricated elements including groove and tongue-like recesses and projections on opposite sides for connecting one of said prefabricated elements with another of said prefabricated elements, said projections engaging corresponding ones of said recesses in an adjacent one of said prefabricated elements when said prefabricated elements are connected together;

applying at least one stiffening and connecting element to at least one of said prefabricated elements and a surface of a room, the surface being at least one of a wall of the room, a floor of the room and a ceiling of the room, said stiffening and connecting element being fixable to the surface using fastening elements;

arranging one of said prefabricated elements at a predetermined position via at least one of fitting said one of said prefabricated elements into said at least one stiffening and connecting element secured to the surface, fitting said one of said prefabricated elements into said at least one stiffening and connecting element at another of said prefabricated elements, and arranging said prefabricated elements with one of said at least one stiffening and connecting element arranged thereon; and fixing said prefabricated elements by connecting said stiffening and connecting elements with fastening elements to at least one of said prefabricated elements adjacent to at least one of said stiffening and connecting elements, and the surface.

9. The method as claimed in claim 8, wherein the intermediate spaces are formed on said prefabricated elements by insertion of said stiffening and connecting elements.

10. The method as claimed in claim 8, wherein said stiffening and connecting elements include U sections having a base and limbs, said U sections being processable in the following steps:

cutting into at least one of said limbs and said base of said U sections, and bending at least a portion of said U sections so that lugs and angled U sections are formed, an axis of bending of said U sections being one of in a base face of said U sections and perpendicular to said base face of said U sections.

11. The method as claimed in claim 10, wherein the working of said U sections further comprises the following step of:

cutting the lugs to form recesses in said limbs of said U sections.

12. The method as claimed in claim 8, wherein said fastening elements are applied directly to said prefabricated elements without preparing said stiffening and connecting elements or said prefabricated elements.

13. The room delimiting means as claimed in claim 2, wherein said conduit elements are in the form of outwardly open channels, and are arranged on one of the two opposite end faces of said core element, which end faces constitute the principal faces of said core element.

14. The room delimiting means as claimed in claim 1, wherein said groove and tongue-like recesses and said projections are formed by channels extending longitudinally in relation to the longitudinal axis of said prefabricated element.

15. The room delimiting means as claimed in claim 14, wherein said stiffening and connecting elements comprise U sections, which include limbs and base faces, said U sections being attachable to said prefabricated elements such that the limbs of said U sections at least one of fit around said tongue-like projections, fit around said core element of said prefabricated elements, fit into an intermediate space in said core element, and fit between said core element and said surface element.

16. The room delimiting means as claimed in claim 5, wherein said U sections are bent at an angle in order to serve as stiffening and connecting elements for at least one of recesses of room delimiting means and a connection of said prefabricated elements, said recesses being configured for at least one of a door, a window and an oblique connection.

17. The method as claimed in claim 8, wherein said fastening elements are applied directly to said prefabricated elements without preparing said stiffening and connecting elements or said prefabricated elements.

18. The method as claimed in claim 8, wherein said stiffening and connecting elements are provided for at least one of stiffening said prefabricated elements, fastening of said prefabricated elements on at least one of the walls, the ceiling and the floor, and connecting said prefabricated elements with one another, said stiffening and connecting elements being arrangable in the recesses and/or intermediate spaces for connecting said prefabricated elements.

19. The method as claimed in claim 8, wherein said fastening elements are provided to connect said stiffening and connecting elements with at least one of the walls, the floor, the ceiling and said prefabricated elements.

20. The room delimiting means as claimed in claim 1, wherein said core element comprises one of a monolithic core element and a composite core element.

* * * * *